United States Patent [19]

Johnson

[11] Patent Number: 4,598,027

[45] Date of Patent: Jul. 1, 1986

[54] TAPE MEASURE HOLSTER

[76] Inventor: Robert L. Johnson, Cityproof Corp., 10-11 43rd Ave., Long Island City, N.Y. 11101

[21] Appl. No.: 801,327

[22] Filed: Nov. 25, 1985

[51] Int. Cl.[4] ..... B65D 85/671

[52] U.S. Cl. ..... 428/542.8; 33/138; 156/212; 220/1 A; 224/904

[58] Field of Search ..... 33/137, 138; 428/542.8; 224/0.5, 252, 269, 904, 906; 156/212; 220/1 A

[56] References Cited

U.S. PATENT DOCUMENTS

| | | | |
|---|---|---|---|
| 241,209 | 5/1881 | Osborn | 428/542.8 X |
| 2,775,822 | 1/1957 | Hinton | 33/138 X |
| 3,009,620 | 11/1961 | Leone | 224/906 X |
| 3,774,309 | 11/1973 | Leopoldi | 33/138 |
| 4,046,308 | 9/1977 | Silver | 428/542.8 X |
| 4,084,015 | 4/1978 | Patterson | 428/542.8 X |
| 4,286,710 | 9/1981 | Higgins | 428/7 X |
| 4,299,344 | 11/1981 | Yamashita et al. | 224/252 X |

*Primary Examiner*—Henry F. Epstein
*Attorney, Agent, or Firm*—Robert W. Fiddler

[57] ABSTRACT

A holster facilitating the carrying of a housing enclosed tape measure; a blank for forming the holster; and a method of forming the holster are disclosed. The holster is formed from a blank of relatively resilient sheet material such as sheet steel or the like dimensioned to provide a planar rear wall of a width slightly larger than that of the rear wall of the housing of the tape measure to be supported. Side walls of a thickness of the tape measure housing are formed extending from the edges of the rear wall, and front flaps are formed on the edges of each side wall with the front flaps dimensioned to permit the passage of a finger therebetween. A spring joint is formed between at least the rear wall and the side walls so as to permit the side walls to flex but biasing the side walls towards each other to frictionally retain a tape measure housing there between. A bottom wall is formed extending from the rear wall and provided with a cut-out of at least finger width. The blank is provided with areas corresponding to the above described holster wall components; and a method is disclosed for bending the blank components into the desired holster configuration.

16 Claims, 4 Drawing Figures

TAPE MEASURE HOLSTER

This invention relates to the art of holsters, and more particularly a holster facilitating the carrying of a housing enclosed tape measure, preferrably by securing the holster to a belt or the like clothing item, with the tape measure maintained in secure position when not in use and subject to selective removal from the holster for use and subsequent replacement for storage.

BACKGROUND OF INVENTION

The desirability of providing supports to facilitate carrying a variety of different tools and the like equipment secured to the clothing of user has long been recognized. To this end a variety of holsters have been evolved for supporting such equipment.

Where tape meausres are employed, the conventional housing enclosed tape measure has in the past been provided with a belt clip secured to the tape measure housing so that the housing may be clipped onto a belt or the waistband of a wearer. Attachment and release of the supporting clip has been found to be problematic in that where the clip is loose enough to permit easy attachment and detachment, the amount of securement is found to be insufficient, and where the clip is tight enough to effect desired securement, release becomes a problem.

BRIEF DESCRIPTION OF THE INVENTION

It is with the above considerations in mind, that the present improved holster has been evolved serving to permit selective maintainance of a housing enclosed tape measure on the belt or waistband of a user with easy removal for use and replacement for storage of the tape measure when desired, and with secure maintainance of the tape measure in desired storage position.

It is accordingly among the primary objects of this invention to provide an improved tape measure holster serving to securely maintain a housing enclosed tape measure on a belt or waistband of a user and at the same time permitting ready removal of the housing enclosed tape measure for use.

Another object of the invention is to provide a tape measure holster permitting release of the tape measure from the holster by simple manual manipulation.

A further object of the invention is to provide a tape measure holster in which securement of the housing enclosed tape measure in the holster for storage is effective, and requires minimal manipulation.

A further object of the invention is to provide a tape measure holster lending itself to ready and firm securement to the waistband or belt of a user.

These and other objects of the invention which will become hereafter apparent are achieved by forming a holster of a relatively resilient sheet material such as sheet steel or the like in which the back, bottom, sides, and front of an open topped holster are formed of a single blank of the resilient sheet material, with the wall members of the formed holster elastically attached at their joints so that they are biased one toward the other from front to back and side to side of the tape measure housing to effect elastic engagement of the tape measure housing. The bottom and front walls of the housing are cut away to permit ready passage of at least a finger of a user so that the tape measure housing may be engaged from the bottom, and slipped up out of the holster. A blank for forming the holster is provided, having areas corresponding to the walls of the holster, and a method of forming the blank into the holster is provided in which the side, front, and bottom areas are bent up from the blank contoured to form these areas.

A feature of the invention resides in its ready formation of sheet steel by conventional metal forming techiques.

Another feature of the invention resides in the fact that the side wall members are biased toward each other, and the front wall members are biased towards the rear wall by spring hinges formed as a result of the natural resiliency of the sheet material of which the holster is formed.

BRIEF DESCRIPTION OF THE DRAWING

The specific details of the invention, and the manner of making and using it will be described in full, clear, concise, and exact tems so as to enable any person skilled in the art to which it pertains to practice same in connection with the accompanying drawings wherein.

DESCRIPTION OF PREFERRED EMBODIMENT

Figure 1:
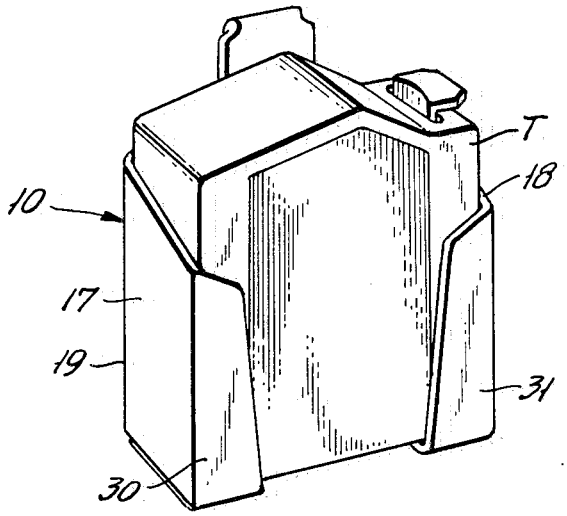
FIG. 1 is a perspective elevational view of a holster with a housing enclosed tape measure held therein.

Referring now more particularly to the drawings, where like numerals in the various figures will be employed to designate like parts, as best seen in FIG. 1, the holster 10 is illustratively shown as of an open-topped box-like configuration.

Holster 10 is formed with a rear wall panel 15 of a planar configuration having a width slightly greater than the width of the housing of the tape measure T (as seen in FIG. 1) to be retained in the holster.

A pair of opposed side walls 17 and 18 illustratively shown as of a rectangular configuration with a height equal to that of the lateral edges of rear wall 15, and a depth (as viewed from front to back in FIG. 2) slightly greater than the thickness of the housing of the tape measure T to be retained. Side walls 17 and 18 are preferrably formed integrally with the back wall 15 of relatively resilient material so that a spring joint 19 and 20 is formed along the line of connection between the lateral edges of rear wall 15 and side walls 17 and 18.

Figure 2:
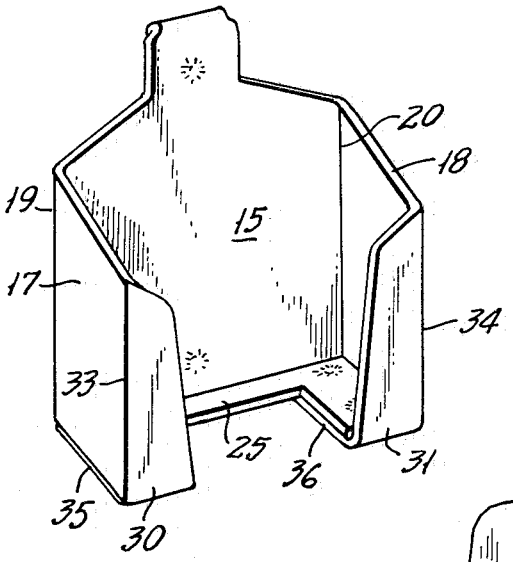
FIG. 2 is a perspective elevational view of the holster without the tape measure contained therein.
Figure 4:
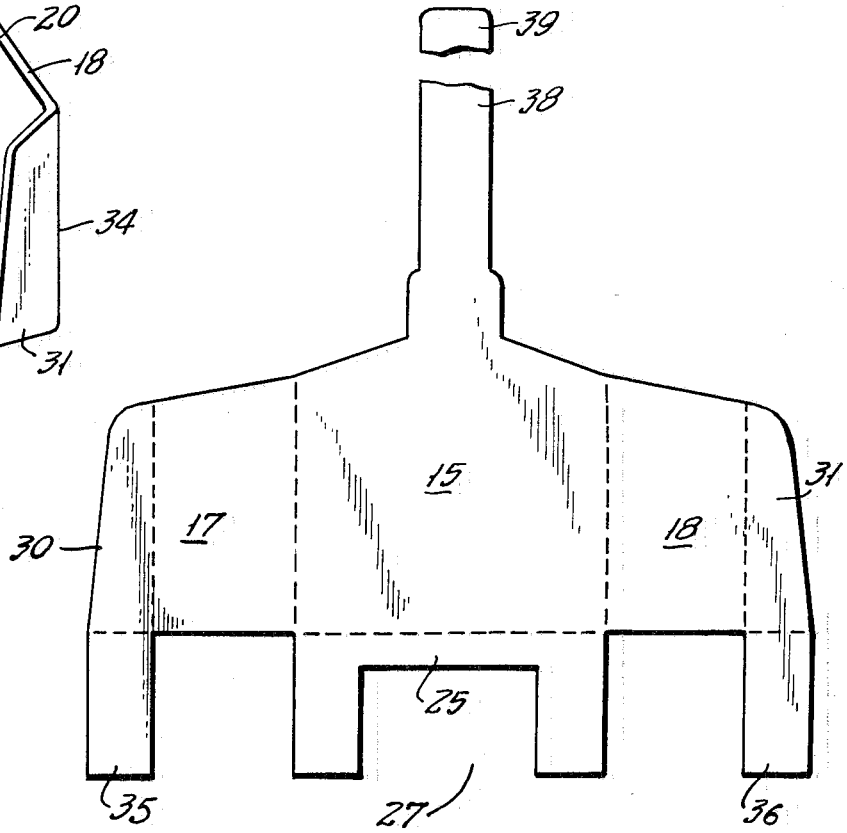
FIG. 4 is a top plan view of a blank of a resilient material employed in forming the holster.

A bottom wall 25 is formed integrally with rear wall 15, and as best seen in FIGS. 2 and 4 is of a U-shaped configuration forming what may be regarded as a rectangle having a centrally cut out portion 27. The length of the rectangle forming bottom wall 25 as viewed from left to right in FIGS. 2 and 4 is preferrably equal to that of the edge of rear wall 15 to which the bottom wall is secured. The width of the bottom wall rectangle is preferably equal to the width of side walls 17 and 18. The cut out 27 which is illustratively shown as of a rectangular configuration is of a dimension such as to permit free passage therethrough of at least one finger of a user. As illustrated, two fingers may readily be accomodated.

Front flaps 30 and 31 are formed integrally with side walls 17 and 18 and joined thereto along the edges of side walls 17 and 18 remote from the rear wall 15 by means of spring joints 33 and 34 serving to bias front flaps 30 and 31 toward the rear wall 15.

Figure 3:
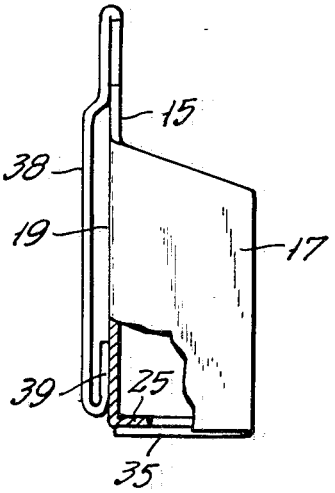
FIG. 3 is a side elevational view with parts broken away of the holster of FIG. 2 illustrating the details of interconnection of the bottom reinforcing flap with the bottom wall.

Extending from the bottom of front flaps 30 and 31, as viewed in FIGS. 2 and 4, are bottom reinforcing flaps 35 and 36 respectively, as illustrated in FIGS. 2 and 3.

A retaining strip 38 as best seen in FIGS. 3 and 4 is formed to extend over and at a spaced distance from the rear surface of rear wall 15, and spacer leg 39 as illustrated in FIG. 3 is upturned at the lower end of strip 38 to provide desired spacing.

In forming the holster of FIGS. 1–3, it is found most expeditious to employ a blank of resilient sheet material such for example as sheet steel, as shown in FIG. 4. The blank is contoured as illustrated and formed with areas corresponding to the holster components above described, with the numeration of the areas on the blank shown in FIG. 4 corresponding to the holster components shown in FIGS. 1–3. Thus blank 4 is formed with a rear wall area 15, side wall areas 17 and 18, front flap areas 30 and 31, a bottom wall area 25, and bottom reinforcing flap areas 32 and 33.

A method, in accordance with the invention, for forming the blank as shown in FIG. 4 into the holster as shown in FIGS. 1–3 comprises the steps of bending the blank along the fold lines as shown by dash lines in FIG. 4 into the configuration illustrated in FIG. 2.

Side walls 17 and 18 are bent up out of the plane of the blank, and front flaps 30 and 31 are bent from side walls 17 and 18 towards each other. Rear wall 25 is bent up on a line between side walls 17 and 18, and bottom reinforcing flaps 32 and 33 are bent up to underlie bottom wall 25.

Spacer leg 39 is bent up against retaining strip area 38 to the configuration illustrated in FIG. 3, and retaining strip area 38 is thereafter bent down along the rear wall 15 to the position illustrated in FIG. 3.

As will be apparent to those skilled in the art, where the holsters are formed of a sheet material such as sheet steel, upon bending of the components of the blank to the configuration shown in FIG. 2, these components will maintain their relative position. However, should it be desirable to insure the maintainance of these components in this position, spot welds may be formed adjacent to the point of fold-over of the retaining clip strip, as best see in FIGS. 2 and 3, and between bottom reinforcing flaps 32 and 33 and bottom wall 25.

OPERATION

The holster 10 as above described may be fabricated in a variety of ways. In accordance with the above described preferred method of formation, a blank, as shown in FIG. 4 is first formed, preferably of sheet steel by conventional sheet metal forming techniques, preferably and most efficiently utilizing a die to cut the sheet metal into blanks of the illustrated configuration.

A variety of sheet metal folding techniques may be employed to fold the blank into the holster configuration illustrated in FIG. 2. As will be apparent to those skilled in the art, a variety of folding dies may be utilized.

After the holster is formed into the configuration illustrated in FIGS. 1 and 2, in use the holster is preferably positioned on the belt of a wearer by either sliding a belt through the loop formed by strip 38, or if spacer 39 is not attached to the rear wall, by clipping the holster over the waistband of a user.

A housing enclosed tape measure dimensioned to be frictionally engaged between the side walls 17 and 18, and front flaps 30 and 31 and rear wall 15. A press fit between the holster walls with respect to the tape measure housing serves to provide desired security of engagement of the housing in the holster.

When it is desired to remove the tape measure from the holster, finger engagement at the bottom of the tape measure housing through the cut-away 27 in the bottom wall of holster permits ready removal of the tape measure from the holster.

It is thus seen that a simple, effective holster has been provided for securely engaging a tape measure housing for carrying at the waist of a user, and at the same time permitting selective removal for use, and ready reinsertion into the holster for storage.

The above disclosure has been given by way of illustration and elucidation, and not by way of limitation, and it is desired to protect all embodiments of the herein disclosed inventive concept within the scope of the appended claims.

What is claimed is:

1. A tape measure holster for supporting a tape measure enclosed in a housing having a rear wall and thickness for selective removal for use and replacement for storage, said holster comprising:

a planar rear wall of a width slightly larger than that of the rear wall of the housing of the tape measure to be supported;

a pair of opposed side walls formed integrally with said rear wall and extending from lateral edges thereof a distance slightly greater than the thickness of the tape measure housing; a spring joint between said rear wall and said side walls biasing said side walls toward each other to engage the tape measure housing;

front flaps formed one on the edge of each side wall remote from said rear wall, said flaps positioned to extend toward each other, and dimensioned to leave a space between the free edges thereof at least equal to the thickness of a finger; a bottom wall formed along the lower edge of said rear wall and extending to said front flaps, said bottom wall having a cut out extending from the front thereof and the space between said front flaps leaving an opening equal to a finger thickness;

and retaining means attached to said rear wall for selectively securing said holster to a support.

2. A tape measure holster as in claim 1 in which said bottom wall is of a substantially rectangular configuration, and the finger cutout is also rectangular.

3. A tape measure as in claim 1 in which said front flaps are outwardly tapered moving from the bottom to the top thereof.

4. A tape measure holster as in claim 1 having a spring joint between said side wall and said front flaps biasing said front flaps toward said rear wall.

5. A tape measure holster as in claim 1, in which said retaining means comprise a strip bent into a loop extending over the rear surface of said rear wall and spaced therefrom.

6. A tape measure as in claim 5 in which a spacer is formed at the end of said strip.

7. A blank for forming a tape measure holster, said blank formed or a resilient sheet material and having:

a rear wall area having substantially parallel lateral edges;

side wall areas, one extending from each lateral edge of said rear wall area;

front flap areas, one on each side of said side wall areas;

a bottom wall area having a cut-out dimensioned to permit a finger to move therethrough, said bottom walls are extending from an edge of said rear wall area between said side wall areas.

8. A blank as in claim 7 in which a bottom wall reinforcing flap area extends from said front flap area in the same direction as said bottom wall area extends from said rear wall area.

9. A blank as in claim 7 in which said bottom wall area is of a substantially rectangular configuration and the cut-out is rectangular with a width less than that of the bottom wall area, and a depth less than that of said bottom wall area.

10. A blank as in claim 7 in which a retaining clip strip area extends from the edge of said rear wall area opposite to the rear wall area edge to which said bottom wall area is connected.

11. A blank in claim 7 in which said front flap areas are of a width equal to the width of the portions of bottom wall area on opposed sides of the finger cut-out of said bottom wall area.

12. A blank as in claim 8 in which said bottom reinforcing flap areas are of a width equal to that of the portions of the bottom wall area on opposed sides of the finger cut-out of said bottom wall area.

13. A method of forming a tape measure holster, said method comprising the steps of:

forming a blank as in claim 7;

bending the side wall areas out of the plane of the blank at an angle of slightly less than 90° to the rear wall area;

bending the bottom wall area out of the plane of the blank at approximately 90° to the plane of the rear wall area;

bending the front wall areas toward each other into a common plane space from the back wall a distance such as to engage the housing of a tape measure in a press fit relationship;

and bending the bottom wall area of the blank out of the plane of the blank to a position at approximately 90° to the rear wall area and lying between the side wall areas.

14. A method as in claim 13 in which said steps are performed in the order recited.

15. A method as in claim 13 in which said steps are not performed in the order recited.

16. A method as in claim 13 in which the bending is performed so as to leave the bend areas with resiliency.

* * * * *